United States Patent [19]

Schoeffler

[11] Patent Number: 4,491,148

[45] Date of Patent: Jan. 1, 1985

[54] AUTOMATIC CHOKE VALVE

[76] Inventor: William N. Schoeffler, P. O. Box 91105, Lafayette, La. 70509

[21] Appl. No.: 488,437

[22] Filed: Apr. 25, 1983

[51] Int. Cl.[3] ..... F16K 17/34

[52] U.S. Cl. ..... 137/499

[58] Field of Search ..... 137/499

[56] References Cited

U.S. PATENT DOCUMENTS 2,447,827 8/1948 Turechek ..... 137/499 X 3,714,957 2/1973 Schoeffler ..... 137/499 X

*Primary Examiner*—Robert G. Nilson

*Attorney, Agent, or Firm*—Keaty & Keaty

[57] ABSTRACT

An automatic storm choke valve having two vertically spaced-apart valve members movable longitudinally within a valve housing to open and close the valve. A pair of vanes pivotally affixed to an upper valve member at its lower end are kept in a preset oblique position by a pair of compression springs, mounted within the upper valve member, allowing a predetermined amount of fluid to pass through the valve. The vanes cause the valve members to rotate responsive to an upward fluid flow within the housing. A pressure equilization chamber affixed below the lower valve member is provided with a compression spring, which in its expanded position tends to keep the valve open.

23 Claims, 4 Drawing Figures

AUTOMATIC CHOKE VALVE

BACKGROUND OF THE INVENTION

1. Field of the Invention

The present invention is in the field of storm chokes for closing oil well production lines or pipelines in the event of a break or sudden increase in fluid pressure.

In production lines from oil wells or in pipelines conducting materials from one location to another, a break in the conduit obviously results in loss of considerable fluid and in many instances it is difficult or impossible to cut off flow and serious damage and loss result. A particularly dangerous situation exists in offshore oil production facilities wherein high seas or other marine events often rupture a production line, thus causing spillage of oil in the surrounding waters and such spillage not only contaminates the water but presents an extremely serious fire hazard. In the event of such an occurrence, it has been heretofore extremely difficult to stem flow from the well.

2. General Background

The present invention provides an improved, extremely simple automatic valve that can be placed in a production line or pipeline. The strom choke valve of the present invention comprises an upper and lower valve housing; an upper seat mated into the top of the upper valve housing and a lower seat mated at the connection between the upper and lower valve housings, thereby connecting the lower and upper valve housings; upper and lower valve members mounted onto a longitudinally extending axle having a longitudinal axis substantially coincidental with the longitudinal axis of the upper and lower valve housings and mounted for reciprocal movement therein, the upper and lower valve members thereby being movable for seating engagement with the upper and lower valve seats, respectively; the upper valve member is fixedly mounted to the axle relative to inclined vanes that cause the valve member and the entire axle and the lower valve member to rotate during fluid flow in the production line or pipeline.

Sufficient background has now been afforded to discuss the improvements of the present invention over the prior art, particularly U.S. Pat. No. 3,714,957. The improvements are as follows:

1. The inclined vanes which are mounted to the upper valve member are not subject to closure by fluid flow through the production line, as in U.S. Pat. No. 3,714,957, but rather, the vanes can only be adjusted to variable open positions and can only be closed by means of a vane adjustment nut circumferentially mounted on the axle, below the vanes, the axle being calibrated so that the operator can preset the degree of opening of the vanes in order to allow a specified amount of fluid flow past the vanes, and if this fluid flow is exceeded, the vanes cause the upper and lower valve members and the entire axle to rotate, and exert a lifting force on the upper valve member, and if the fluid flow is increased enough, the vane rotates more rapidly and a greater lifting force is applied to the upper valve member, thereby causing the entire axle and the upper and lower valve members mounted thereto to rise within the upper and lower valve housings, so that the upper and lower valve members are pulled into seating engagement with the upper and lower valve seats, respectively, and thus, automatically close the pipe against further or continued flow therethrough;

2. A lower seal housing having a lower shaft rotatably mounted therein, the lower shaft being mated on its top to the lower end of the lower valve member, the top of the seal housing communicating with the bottom surface of the lower valve member, thereby defining the lowermost movement of the lower valve member; a compression spring circumferentially mounted to the lower portion of the lower shaft at the bottom of the seal housing, and the lower shaft is secured within the seal housing by a lower bushing and an upper bushing, O-ring seals, and a lock ring and washer;

3. A plug having breather vents in its lower portion is mated at its top end with the lower end of the seal housing, thereby fluidly sealing the seal housing; the seal housing is secured within the lower valve housing by means of spiders or support fins being welded to the outer surface of the seal housing and the inner surface of the lower valve housing;

4. The weight of the upper and lower valve members downwardly biases the compression spring mounted to the lower shaft within the seal housing, and this bias can only be reversed by increased fluid flow velocity which causes the inclined vanes mounted to the upper valve member to rotate, thereby exerting a lifting force on the upper valve member and thus, the vanes, the axle, and the lower valve member, and this lifting action is further enhanced by the decompression of the compression spring and the resultant upward movement of the lower shaft and the lower valve member mounted thereto, and thus, the upper axle and the upper valve member, ultimately resulting in the seating engagement of the upper valve member and the lower valve member with the upper and lower valve seats, respectively, thus automatically closing the pipe or production line against further or continued flow therethrough.

The invention disclosed herein contemplates forms for employment in vertical production lines or in horizontal production lines.

Many other objects and advantages of the present invention will become apparent from the following detailed description taken in conjunction with the accompanying drawings.

DETAILED DESCRIPTION OF THE PREFERRED EMBODIMENT

Figure 1:
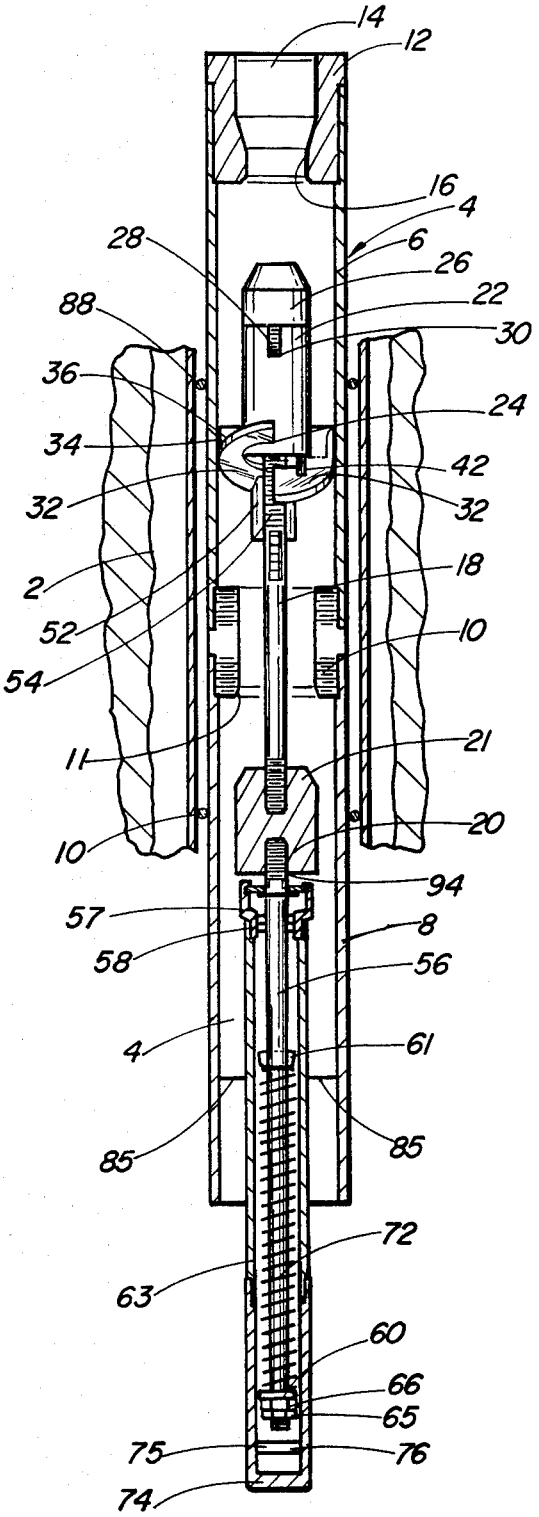
FIG. 1 is an elevational, cross-sectional view of the present invention employed within a vertical production line.
Figure 2:
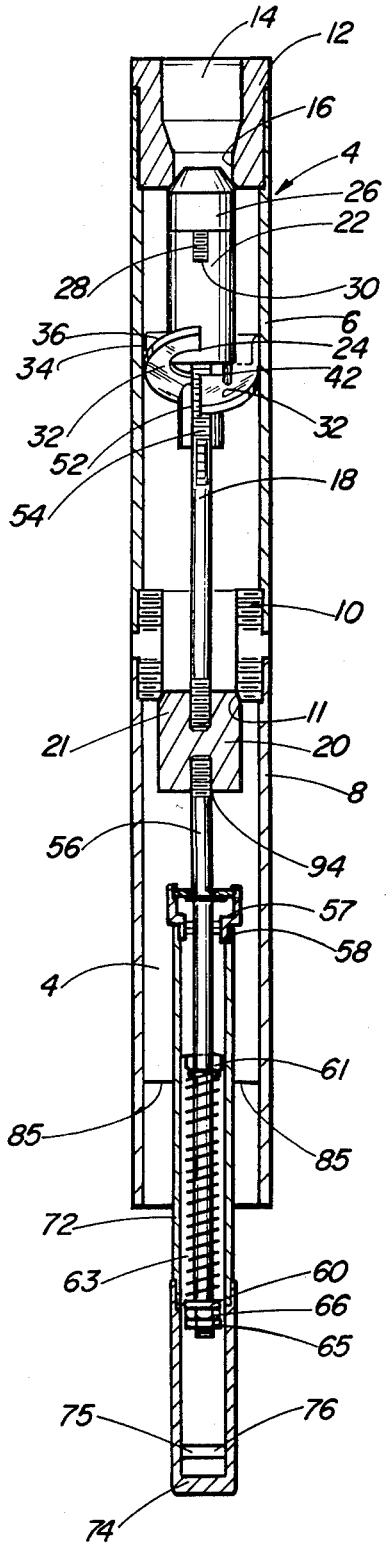
FIG. 2 is an elevational, cross-sectional view of the present invention in isolation.
Figure 3:
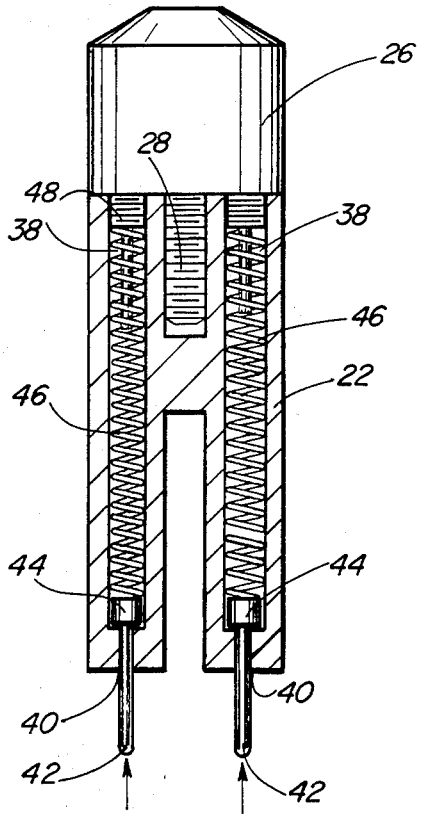
FIG. 3 is an isolated, elevational cross-sectional view of the upper solid member of the present invention with the top frusto-conical solid member therein inserted.
Figure 4:
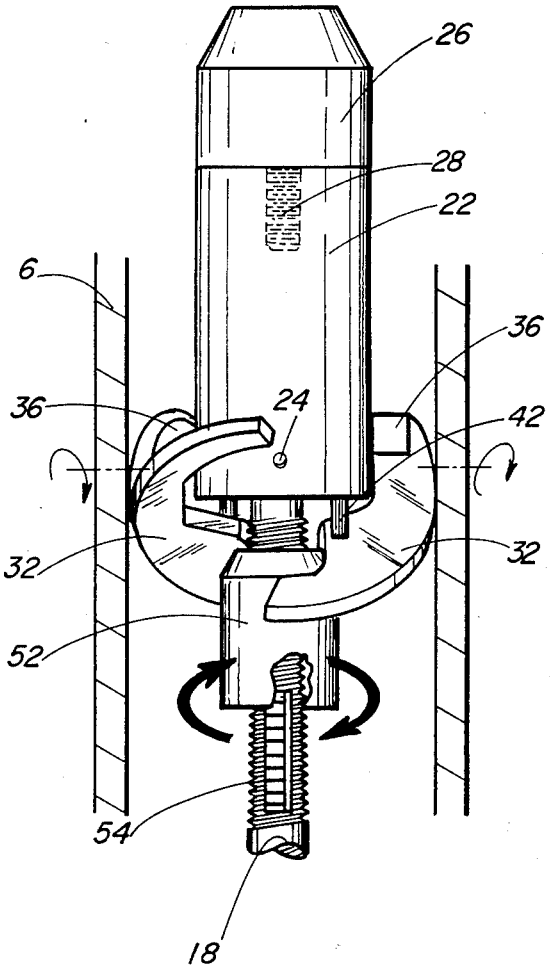
FIG. 4 is a fragmentary view of the upper part of the apparatus of the present invention.

Referring now to FIG. 1, numeral 2 indicates a generally vertically extending oil well production line, which may be a well casing or a separate pipe therein, the apparatus of the present invention, indicated generally by numeral 4, being depicted mounted therein. Referring now to FIG. 2, there can be seen the apparatus of the present invention, indicated generally by the numeral 4, in isolation (i.e. not mounted within the production line), wherein the present invention comprises, from top to bottom, an upper valve housing 6 and a lower valve housing 8, connected together by internal, lower collar 10 having an annular valve seat 11; an upper collar 12 having a larger upper bore 14 and a lower, annular valve seat 16, is mated with the machine-threads provided in the top end of the upper valve housing 6; an upper shaft 18, or upper axle 18, mounted on its lower end to a lower, solid head member 20 having a substantially conical top portion 21, and mated on its upper end to an upper, solid head member 22, such as by set screw 24 (head member 22 hereinafter referred to as upper valve member 22); a substantially conical, solid head member 26 having a lower threaded stud 28 which is mated into a machine-threaded central bore 30 provided in upper valve member 22 for receiving same; a pair of generally semi-circular vanes 32 pivotally mounted on upper valve member 22 by means of a pivot pin 34, which extends through upper valve member 22 and through upwardly extending ears 36 on the vanes 32. Upper valve member 22 is provided with a pair of diametrically spaced bores 38 terminating at their lower ends in smaller openings 40 through which shanks 42 of slidable thrust plugs 44 slidably extend. The shanks 42 are positioned to bear at their lower ends on the upper surfaces of their respective vanes 32, each at a position laterally displaced from the pivot pin 34. Within each bore 38 is a compression spring 46, bearing at its lower end on the thrust plug 44, held under compression by an adjustable threaded plug 48 threaded into the upper end of the bore 38. Thus, plugs 48 may be preset or pre-adjusted to provide the desired valve of compression force stored in springs 46 and thus predetermine the torque applied by shanks 42 to the vanes 32, which torque normally holds vanes 32 in the tilted or oblique position shown in FIGS. 1 and 2. In the preferred embodiment of the present invention, adjustable threaded plug 48 is preset or pre-adjusted to provide a compression force to springs 46 which makes vanes 32 non-responsive to any amount of upward fluid pressure, the degree of the tilt of the vanes 32 being solely adjustable by means of vane adjustment nut 52 which is provided with internal threads to mate with the machine-threaded portion 54 of upper axle 18 below upper valve member 22. The degree of the tilt of the vanes 32 regulates the amount of fluid allowed to flow therepast. The machine-threaded portion 54 of upper axle 18 is calibrated to indicate the amount of fluid which would be allowed to flow past the vanes 32 at the particular setting selected. In the preferred embodiment, the machine-threaded portion 54 of upper axle 18 is calibrated with two separate sets of markings for indicating the flow which would be permitted past vanes 32, for the various settings of the vane adjustment nut 52, one set of markings representing the calibration for natural gas flow and the other set of markings representing calibration for crude oil flow. As is further apparent from FIG. 4, the downwardly facing area of each vane 32 is considerably greater on one side of the pivot pin 34 than the area of that vane on the other side of pivot pin 34. Thus, any upward fluid pressure applied to the lower surfaces of the vanes 32 will apply a net torque thereto in direction tending to rotate each vane about the pivot pin 34 in opposition to the torque provided by the compression springs 46.

Referring again to FIG. 2, a lower, reciprocable shaft 56, or lower axle 56, is provided with machine-threads at its top end for mating a machine-threaded, lower, central bore 94 provided through lower valve member 20. Lower shaft 56 extends through and is journalled in O-ring seals 57, 58 and bushings 60, 61 within seal housing 63 whereby it is rotatable therein and axially movable therethrough. Seal housing 63 is affixed within lower valve housing 8 by means of fins 85 or spiders 85 being welded, for example, to the inner wall of lower valve housing 8 and the outer surface of seal housing 63. A compression spring 72 surrounds the lower shaft 56 from a point substantially downstream from bushing 61, in the preferred embodiment, downwardly to a point substantially near the lower end of lower shaft 56. Compression spring 72 is retained onto shaft 56 by means of washer 65, and one or more spring retainer nuts 66, 67. Plug-in 74 is inserted into the bottom end of seal housing 63, thereby fluidly sealing seal housing 63, thereby preventing fluid flow therethrough except through breather vents 75, 76 which permit the intake and exhaust of fluid.

In operation, the upper valve housing 6 and the lower valve housing 8 are inserted into the oil well production line 2, the larger upper bore 14 of upper collar 12 being threaded for mating an adaptor (not shown) which engages a down hole lock (not shown) within the bore of production line 2, thereby securing upper valve housing 6 and lower housing 8 within the bore of production line 2. O-rings 88, 90 ensure a fluid seal between the upper and lower valve housings 6, 8 and the oil well production line 2. When production fluid is flowing upwardly into conduit 2, that flow of fluid past the tilted vanes 32 will apply an upward fluid pressure to the lower surfaces of the vanes, thereby applying a net torque thereto in a direction tending to rotate each vane about the pivot pin 34 in opposition to the torque provided by the compression springs 46 thereby ensuring that vanes 32 remain in their preselected tilted position and only a certain amount of fluid passes between the vanes and the inner walls of upper valve housing 6. It will also be obvious that the rotation of tilted vanes 32 will cause the upper axle 18 and the upper valve member 22 and lower valve member 20 mounted thereto, and lower shaft 56, to also rotate. The vane adjustment nut 52 is manually, or otherwise, adjusted to the desired setting to allow a preselected amount of fluid flow past the vanes 32 and through the upper valve housing 6 and therethrough through the production line 2. Some of the fluid flowing through the production line 2 upwardly into the lower valve housing 8 will enter through breather vents 75, 76 of plug-in 74 to prevent buoyancy of plug-in 74, which would cause an undue increased velocity of fluid flow, thereby resulting in malfunctioning of the device. Any increase in fluid flow beyond the amount of fluid flow desired to be allowed past vanes 32 as is predetermined by preselecting the setting of vane adjustment nut 52, will cause an increased rotation of vanes, 32, thereby creating a rotating/lifting force on vanes 32, thereby causing the upper axle 18, upper valve member 22, the lower valve member 20, and the lower shaft 56, to simultaneously rotate and be lifted and ultimately head member 26 of upper valve member 22 will engage its seating surface 16, and top portion 21 of lower valve member 20 will engage its seating surface 11, thereby stopping all flow of fluid through lower valve housing 8 and upper valve housing 6. The above described lifting/rotating action is enhanced by the action of compression spring 72; in its normal state, spring 72 tends to hold the valve open, it is decompressed as best shown in FIG. 1 with its lower end bearing on bushing 60 and its upper end pushing against bushing 61 therefore, any lifting of the upper valve member 22 and the lower valve member 20 causes a commensurate compression of compression spring 72, thereby upwardly urging lower shaft 56, lower valve member 20, upper axle 18, and upper valve member 22. Thusly, compression spring 72 enhances the rotating-/lifting action caused by an increased velocity of fluid flow past vanes 32, thereby substantially lessening the time gap between the point at which the velocity of fluid flow exceeds the maximum allowable flow according to the setting of the vane adjustment nut 52, and the seating of the head member 26 of upper valve member 22 with its valve seat 16 and the seating of top portion 21 of lower valve member 20 with its valve seat 11, thereby preventing a potentially damgerous situation in the event that the production line 2 may rupture or break, or in the event of a sudden surge of high pressure in the production line it is important to note that breather vents 75, 76 serve as pressure equilization means to permitting a flow of oil or gas into the interior of chamber 63, which houses spring 72, since chamber 63 is sealed against the flow operating valve head members 20, 22 and vanes 32. The provision of two valve members and the provision of a spring-action lower shaft are major improvements over the prior art, as they facilitate a more effective, and quicker action sealing means to prevent the flow of fluid through the valve, thereby preventing potentially dangerous situations, either subsurface or at the surface. Note that when the fluid flow is decreased below the preselected maximum level, the lowermost movement of lower valve member 20 is defined by the upper surface of seal housing 63.

While specific embodiment of the present invention has been shown and described, the same is merely illustrative of the principles involved and other forms will be obvious to those skilled in the art, within the scope of the appended claims.

What is claimed as invention is:

1. An improved automatic storm choke valve for preventing excessive fluid flow through a fluid flow conduit, comprising:

a. a valve housing mounted within said fluid flow conduit in fluidly sealing engagement thereto;

b. upper and lower valve seats fixedly mounted within said housing;

c. an upper axle mounted for reciprocal axial movement within said housing, between said upper and lower valve seats;

d. upper and lower valve members circumferentially fixedly mounted to an upper and lower ends of said upper axle respectively, whereby said upper and lower valve members are reciprocable with said upper axle for axial movement between an unseated, open position to a closed seated position, whereby said upper and lower valve members are engaged in fluidly sealing, seating engagement with said upper and lower valve seats, respectively;

e. adjustably inclined vane means pivotally attached to said upper valve member, said vane means extending obliquely to a longitudinal axis of said fluid flow conduit, thereby being responsive to fluid flow therepast to impart rotation to said upper axle and said upper and lower valve members mounted thereto;

f. compression means mounted within said upper valve member, bearing at their lower ends on said vane means to predetermine the amount of torque applied to said vane means by holding them in the oblique position;

g. a pressure equilization means mounted below said lower valve member and fixedly attached thereto.

2. The apparatus of claim 1, wherein said fluid flow conduit comprises an oil well production pipeline.

3. The apparatus of claim 1, wherein the pressure equilization means comprises:

a. a seal housing fixably mounted at least in part within said valve housing below said lower valve member;

b. a lower axle rotatably mounted at least in part within said seal housing, said lower axle being affixed to the lower end of said lower valve member;

c. a compression spring mounted in at least partially surrounding relationship to said axle within said seal housing, the compression spring being adapted to expand and keep the valve members in the open position and compress to bring the valve members into the closed position;

d. spring retaining means axially slidable within said seal housing for defining the lowermost movement of said compression spring;

e. plugging means inserted into the lowermost end of said seal housing and having breather vents for permitting a predetermined amount of fluid into said seal housing.

4. The apparatus of claim 3, wherein said valve housing comprises an upper valve housing and a lower valve housing connected together by said lower valve seat.

5. The apparatus of claim 4, wherein said upper valve member comprises a generally cylindrical, solid head member.

6. The apparatus of claim 5, wherein said upper valve member comprises a substantially conical top member and a substantially cylindrical bottom member provided with a central, threaded bore and a pair of diametrically spaced bores terminating at their lower ends in smaller openings, and wherein said top member is provided with a centrally located threaded stud attached to its bottom surface for screwably mating with said central bore of said bottom member.

7. The apparatus of claim 6, wherein it further comprises a set screw for attaching said upper valve member to said upper axle.

8. the apparatus of claim 7, wherein it further comprises a compression spring mounted within each of said diametrically spaced bores provided in said bottom member.

9. The apparatus of claim 8, wherein it further comprises threaded plug threaded into the upper end of each of said diametrically spaced bores of said bottom member of said upper valve member, for adjustably holding said compression springs mounted within each of said diametrically spaced bores under compression.

10. The apparatus of claim 9, wherein said vane means comprises a pair of generally semi-circular vanes pivotally mounted near the lower end of said bottom member of said upper valve member.

11. The apparatus of claim 10, wherein it further comprises thrust plug having a shank extending centrally through its bottom end, slidably mounted within each of said diametrically spaced bores of said bottom member of said upper valve member below said compression spring, said shanks extending through said smaller openings of said bottom member, said shank bearing at their lower ends on the upper surfaces of their respective vanes, each at a position laterally displaced from said pivot attachement, for applying torque to said vanes, the magnitude of said torque being dependent upon the pre-adjustment of said adjustable threaded plugs.

12. The apparatus of claim 11, wherein said adjustable threaded plugs are pre-adjusted to provide a compression force to said compression springs which causes said shanks of said slidable thrust plugs to apply a torque of such magnitude to said vanes which makes said vanes non-responsive to any amount of upward fluid pressure.

13. The apparatus of claim 12, wherein a substantial portion of said upper axle below said upper member is machine-threaded.

14. The apparatus of claim 13, wherein it comprises a vane adjustment nut provided with internal threads, circumferentially mounted to said machine-threaded portion of said upper axle, thereby providing a means for adjusting the degree of the tilt of said vanes, for thereby regulating the amount of fluid allowed to flow therepast.

15. The apparatus of claim 14, wherein the machine-threaded portion of said upper axle is calibrated to indicate the amount of fluid which is allowed to flow past said vanes at each particular setting of said vane adjustement nut.

16. The apparatus of claim 15, wherein said downwardly facing area of each said vane is considerably greater on one side of said pivot attachment than the area of said vane on the other side of said pivot attachment, whereby an upward fluid pressure applied to the lower surfaces of said vanes applies a net torque thereto in a direction tending to rotate each said vane about said pivot in opposition to the torque provided by said compression springs.

17. The apparatus of claim 16, wherein said lower valve member is provided with a lower, central bore and an upper, annular valve seat.

18. The apparatus of claim 17, wherein it further comprises a reciprocable axle provided with machine-threads at its top end, mated at its machine-threaded top end with said machine-threaded, lower, central bore provided through said lower valve member.

19. The apparatus of claim 18, wherein it further comprises a housing fixably mounted within said lower valve housing below said lower valve member in at least partially surrounding relationship to said lower axle by means of a pair of fin elements being fixably attached at one end to the inner wall of said valve housing and on its other end to the outer surface of said seal housing.

20. The apparatus of claim 19, wherein said lower axle is rotatably mounted within said seal housing.

21. The apparatus of claim 20, wherein said compression spring is mounted in at least partially surrounding relationship to said lower axle within said sealing hosing.

22. The apparatus of claim 21, wherein said spring retaining means for defining the lowermost movement of said compression spring comprises a washer and at least one retainer nut.

23. The apparatus of claim 22 wherein it further comprises a pair of O-ring seals and a pair of bushings mounted within said seal housing for journalling said lower shaft, whereby said lower shaft is rotatable therein and axially movable therethrough.

* * * * *